US009011278B2

(12) United States Patent
Lay

(10) Patent No.: US 9,011,278 B2
(45) Date of Patent: Apr. 21, 2015

(54) BARRIER SUPPORT STRUCTURE

(76) Inventor: William Coleman Lay, Saint George, UT (US)

( * ) Notice: Subject to any disclaimer, the term of this patent is extended or adjusted under 35 U.S.C. 154(b) by 381 days.

(21) Appl. No.: 13/115,795

(22) Filed: May 25, 2011

(65) Prior Publication Data

US 2012/0302381 A1 Nov. 29, 2012

(51) Int. Cl.

*A63B 69/00* (2006.01)
*A63B 71/02* (2006.01)
*A63B 63/00* (2006.01)

(52) U.S. Cl.

CPC ..... *A63B 71/022* (2013.01); *A63B 2063/001* (2013.01); *A63B 2210/50* (2013.01); *A63B 2210/54* (2013.01); *A63B 2243/0004* (2013.01); *A63B 2243/0029* (2013.01); *A63B 2243/0045* (2013.01); *A63B 2243/007* (2013.01); *A63B 2243/0083* (2013.01)

(58) Field of Classification Search

CPC ..... A63B 63/00; A63B 63/004; A63B 69/00; A63B 69/0002; A63B 69/0024; A63B 69/0097; A63B 67/002; A63B 67/20; A63B 2069/0006; A63B 2243/00

USPC ..... 473/454–456, 421, 422, 197, 434, 435, 473/446, 449, 470, 471, 476–478; D21/699, 705

See application file for complete search history.

(56) References Cited

U.S. PATENT DOCUMENTS 1,399,761 A * 12/1921 Garland ..... 473/258
3,820,787 A * 6/1974 Heinbigner ..... 473/439
4,092,023 A * 5/1978 Hazen ..... 473/454
5,269,527 A * 12/1993 Noval ..... 473/197
5,707,062 A * 1/1998 Perillo et al. ..... 273/400
5,842,940 A * 12/1998 Macaluso ..... 473/478
5,976,023 A 11/1999 Cho
D422,326 S * 4/2000 Lai ..... D21/699
6,312,343 B1 11/2001 Cho
6,354,968 B1 * 3/2002 Nozato ..... 473/421
6,357,510 B1 * 3/2002 Zheng ..... 160/354
6,511,390 B2 * 1/2003 Kim ..... 473/446
6,554,717 B2 4/2003 Cho
6,604,537 B2 8/2003 Zheng
6,607,455 B1 * 8/2003 Petras ..... 473/478
6,620,064 B2 * 9/2003 Nickerson ..... 473/431
7,021,630 B1 * 4/2006 Cho ..... 473/454
7,156,761 B2 * 1/2007 Mesa ..... 473/451
7,198,274 B2 * 4/2007 Cho ..... 473/454
7,264,245 B2 * 9/2007 Cho ..... 473/454
7,600,759 B2 * 10/2009 Crawley et al. ..... 473/454
7,651,098 B2 * 1/2010 Cho ..... 273/400
7,744,089 B2 * 6/2010 Huang ..... 473/478
8,322,725 B2 * 12/2012 Cho ..... 473/454
8,403,330 B2 * 3/2013 Cho ..... 473/478
2003/0032493 A1 * 2/2003 Lin ..... 473/197
2003/0203775 A1 * 10/2003 Wong ..... 473/478
2003/0236140 A1 * 12/2003 Alford ..... 473/454
2005/0176518 A1 * 8/2005 Doherty et al. ..... 473/197
2011/0092321 A1 * 4/2011 Szaro et al. ..... 473/478

* cited by examiner

*Primary Examiner* — Mitra Aryanpour

(57) ABSTRACT

The present invention provides for the first time a barrier support structure comprising at least one removable closed-loop resilient coilable frame having a perimeter. The removable closed-loop coilable frame comprises at least one connection member. A support base comprises at least one attachment member. The attachment member removably attaches to the connection member of the removable coilable frame. The attachment member maintains a predetermined angle between the removable coilable frame and the support base.

6 Claims, 8 Drawing Sheets

BARRIER SUPPORT STRUCTURE

BACKGROUND OF THE INVENTION

1. Field of the Invention

The present invention relates to sports products and more particularly to a barrier support structure used by athletes for stopping the flight of projectiles such as baseballs, softballs, footballs, golf balls, soccer balls, tennis balls, hockey pucks, and the like.

2. Description of the Prior Art

In many sports, two of the most difficult skills to master is hitting and throwing. Many athletes use practice nets to hit or throw into for developing good hitting and throwing skills.

One type of commonly used practice net is called a pop-up net. A pop-up net is a net that is coiled up in its storage state and then pops-up or automatically uncoils when the user sets it up for use.

One advantage of this type of net is there is limited assembly time. This means that unlike many conventional practice nets that take a great deal of time to set-up and take down, a pop-up net can be assembled and coiled up for storage in a matter of seconds. The pop-up type of net is considered to be a very convenient and portable practice net.

However, there are many drawbacks to the conventional pop-up net. For example, typical pop-up nets are configured to have a front pop-up section fixedly attached to a base pop-up section. This allows both sections to lay one on top of the other and so the user can coil both sections up at the same time.

The problem with this design is you have to have separate rigid support braces to brace between the front pop-up section and the base pop-up section or the front pop-up section be able to stand in an upright position. This upright position is required for stopping projectiles.

Another problem can occur because the braces are not attached to the front pop-up section or the base pop-up section. Because of this, the braces can get lost and this makes the pop-up net useless.

Yet another problem can occur when the front netting wears out. You see, to produce a pop-up net frame, it can require a great deal of spring steel to form both the perimeter of the front pop-up section and the base pop-up section. As you may know, spring steel is fairly expensive, and in addition, most pop-up nets have a fabric sleeve sewn around entire perimeter of the spring steel frame. In addition, the front pop-up section also has netting sewn into the fabric sleeve.

As you can see, it can be fairly expensive to create a pop-up net. Here's where the next problem can come in.

The majority of balls, pucks, or the like repeatedly hit into the netting of the front pop-up net section, so as you can see this is where most of the wear and tear occurs. In many cases the net wears out and the entire pop-up net needs to be thrown away.

In this case, you still have a quality front pop-up frame and a quality base pop-up frame but you have to throw the entire pop-up net away because the bad front pop-up frame is fixedly attached to the base pop-up frame.

Now, imagine for a minute that the two pop-up frames were removably attached to each other. In this instance, you would just have to purchase a replacement front pop-up net section and attach it to good pop-up base. This new removable design will allow you to save money, resources, and also to save the landfills from throwing away parts that are still good.

In addition, let's say you want to create a product that has multiple purposes. For example, let's say you want to have a front pop-up net configured to stop the balls, another front pop-up net configured to catch the balls, and yet another front pop-up net configured to be a protective L-screen used when a player pitches batting practice to a batter.

In this case, you would have to purchase three different front pop-up nets all with fixedly attached bases. Remember, in most cases the pop-up base can cost almost as much as the front pop-up net section.

As you can see, since the two sections are fixedly attached you have to pay for the three of the same bases when in reality you only need one base. Let me explain.

By making the front pop-up next section removably attached from the base, you would only have to pay for three front pop-up net sections and one pop-up base section. This would save the production cost of two base sections.

Now, for marketing reasons, let's say you want to offer a product you call a 3-in-1 pop-up net. In this case you would only have to pay for the manufacturing costs of three front pop-up net sections and one base section while your competition would have to pay for all three base sections. This would make your competitors products much higher in price and could give you a distinct competitive advantage in the marketplace.

Also, let's say you don't want the base to be a flimsy pop-up type of base, but would rather have a rigid tubular steel frame. Many people perceive a tubular steel base as a much higher value than the pop-up type of frame. In addition, since you are using rigid tubular steel for your base, the rigid base is strong enough to support the front pop-up net section so you won't need extra support braces that can get lost.

Further, with a rigid base you can attach hinges so the base can support the front pop-up net section at various angles.

In addition, since you are using a rigid base, you can mount various objects to the rigid base. For example, let's say you wanted to mount a pitching machine to the base so you wouldn't have to pay for an additional stand. Let's say you wanted to mount a batting tee to the rigid base to act as a support, or let's say you wanted to mount a pole to hang a ball from so you could hit the mounted ball into the front section of the pop-up net.

As you can see, a front pop-up net that is removable from a support base has many advantages and benefits.

OBJECTS AND ADVANTAGES

Therefore, it is one object of the present invention to provide for the first time a barrier support structure that has a front pop-up frame section removably attached to a support base.

It is another object of the present invention to provide for the first time several uniquely different front pop-up net embodiments that can be combined and removably attached to one standard support base.

It is a further object of the present invention to provide for the first time an easy and cost effective way to replace a worn out front pop-up net section without having to throw away a good support base.

It is still another object to provide a rigid support base that can support the front pop-up section without having to have separate support braces. These support braces can get lost and render the pop-up net useless.

It is yet another object to provide a support base for the pop-up net front section that can act as a mounting base for various objects such as pitching machines, batting tees, and hitting trainers.

Further objects and advantages of the present invention will become apparent upon reading the following detailed description of embodiments of the invention when taken in conjunction with the appended claims.

SUMMARY OF THE INVENTION

In accordance with one embodiment, there is provided for the first time a barrier support structure comprising at least one removable closed-loop resilient coilable frame having a perimeter. The removable closed-loop coilable frame comprises at least one connection member. A support base comprises at least one attachment member. The attachment member removably attaches to the connection member of the removable coilable frame. The attachment member maintains a predetermined angle between the removable coilable frame and the support base.

Other features of the present invention will become apparent upon reading the following detailed description of embodiments of the invention when taken in conjunction with the appended claims.

BRIEF DESCRIPTION OF DRAWINGS

To further clarify the above and other advantages, and features of the present invention, a more particular description of the invention will be rendered by references to specific embodiments thereof, which are illustrated in the appended drawings. It is appreciated that these drawings depict only typical embodiments of the invention and are therefore not to be considered limiting of its scope. The invention will be described and explained with additional specificity and detail through the use of the accompanying drawings in which.

REFERENCE NUMERALS OF DRAWINGS

Figure 1:
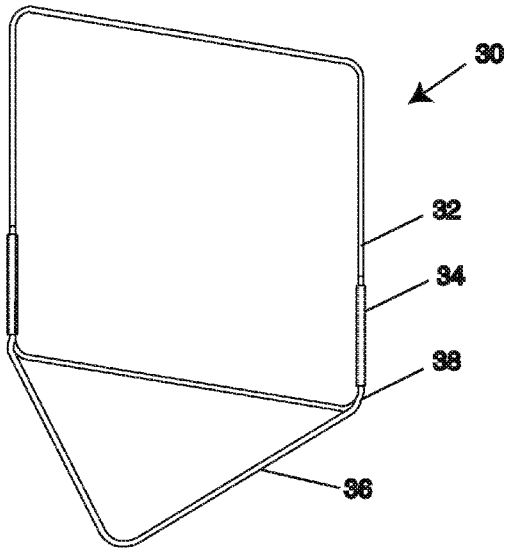
FIG. 1 is a perspective rear view illustrating a barrier support structure embodiment.
Figure 2:
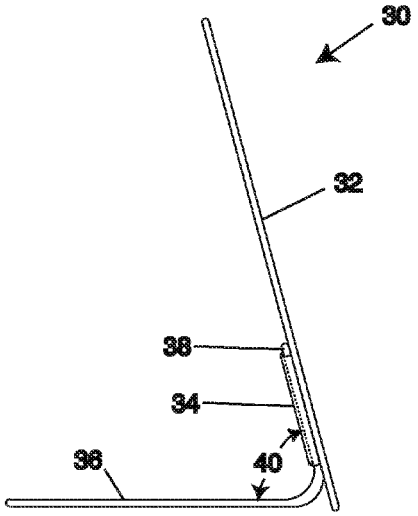
FIG. 2 is a side view of a barrier support structure illustrating at least one removable closed-loop resilient coilable frame with at least one connection member, and a support base with at least one attachment member attached to the connection member for supporting the removable coilable frame at a predetermined angle.
Figure 3:
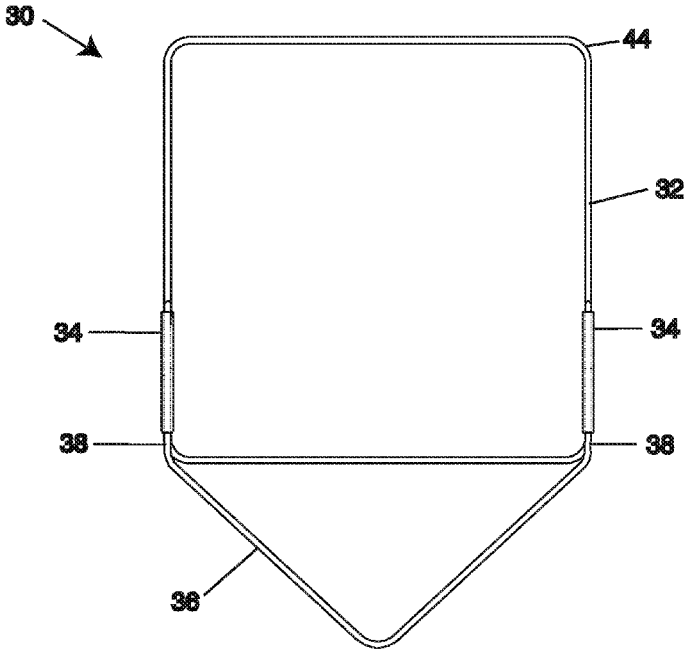
FIG. 3 is a perspective rear view of a barrier support structure illustrating at least one removable closed-loop resilient coilable frame with at least one connection member, and a support base with at least one attachment member attached to the connection member for supporting the removable coilable frame.
Figure 4:
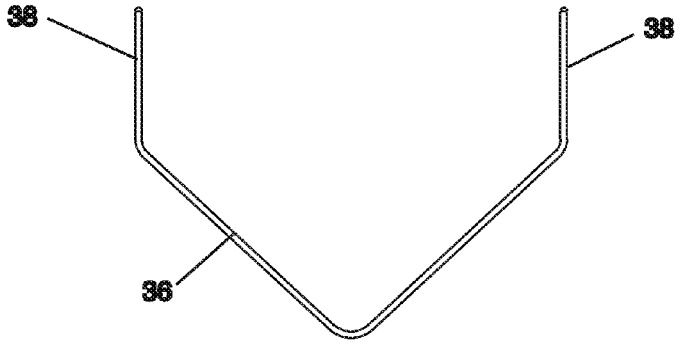
FIG. 4 is a perspective rear view of a support base with at least one attachment member for attaching to at least one connection member of at least one removable closed-loop resilient coilable frame.

30 barrier support structure
32 at least one removable closed-loop resilient coilable frame having a perimeter
34 at least one connection member
36 support base
38 at least one attachment member
40 predetermined angle between the support base and the at least one attachment member
42 overlapping coils
44 substantially square in shape removable closed loop resilient frame
46 barrier portion
48 pocket
50 target
52 tubular fabric sleeve
54 at least one corner support
56 pivoting mechanism
62 foldable attachment member
64 catch
66 opening
67 trough
68 projectile collector
70 compact projectile collector in folded position
72 at least one stand
74 ball return
76 projectile
80 at least one resilient strap
82 substantially L-shaped barrier support structure
84 substantially H-shaped support base
86 barrier portion cavity

DETAILED DESCRIPTION OF THE PREFERRED EMBODIMENTS

FIGS. 1-5 illustrate a barrier support structure 30 comprising at least one removable closed-loop resilient coilable frame 32 having a perimeter, the removable closed-loop coilable frame 32 comprises at least one connection member 34; and a support base 36 comprising at least one attachment member 38, the attachment member 38 is removably attached to the connection member 34 of the removable coilable frame 32, the attachment member 38 maintains a predetermined angle 40 between the removable coilable frame 32 and the support base 36.

To fabricate one embodiment of a barrier support structure 30 you can create at least one removable closed-loop resilient coilable frame 32 by acquiring a resilient material such as spring steel, fiberglass rod, or any material that can be resiliently formed into a perimeter.

In the present embodiment, the perimeter can be continuous and formed into many different sizes as small or as large as desired. For example, a 4'×4' perimeter, 5'×5' perimeter or a 7'×7' perimeter. Also, the removable coilable frame 32 can be substantially square in shape 44, round, oval, or any other shape desired.

Once the removable coilable frame 32 is formed into a perimeter, you can secure its form by welding, crimping, or using any means acceptable for securing the two ends of the removable coilable frame 32 together. You can also make the securing method rotational so the two ends can rotate when secured together.

Once the removable coilable frame 32 is formed, you can create at least one connection member 34 by attaching a metal tube, a fabric sleeve, a magnet, or any other acceptable connection method to the removable coilable frame 32. In some cases, the connection member 34 can be a formed into a female receptor, a male receptor, or a flat member.

In another embodiment, it is preferable to attach one connection member 34 to the lower half of the right side of the removable coilable frame 32, and another connection member 34 to the lower half of the left side of the removable coilable frame 32.

To attach the connection members 34 to the removable coilable frame 32, many attachment methods can be used such as welding, sewing, bolting, Velcro fastening or the like.

A support base 36 can be formed out of tubular steel, flexible spring steel, fiberglass rod, a ground stake, or any material suitable for supporting a removable coilable frame 32 on a surface.

In one embodiment, the support base 36 is free standing while in another embodiment, the support base 36 mounts into a surface such as the ground.

In one embodiment, the support base 36 is formed into a V-shape out of 1.25" tubular steel. At least one end of the support base 36 has a 105 degree bend formed to create at least one attachment member 38. This attachment member 38 can extend upwardly at a predetermined angle. Once formed, the attachment member 38 slides into, over, or up against the connection member 34 of the removable coilable frame 32.

In another embodiment, two ends of the support base 36 have 105 degree bends formed to create two attachment members 38. These two attachment members 38 extend upwardly at a predetermined angle and slide into, over, or up against two connection members 34 of the removable coilable frame 32. The attachment members 38 support the removable coilable frame 32 at a predetermined angle.

Figure 5:
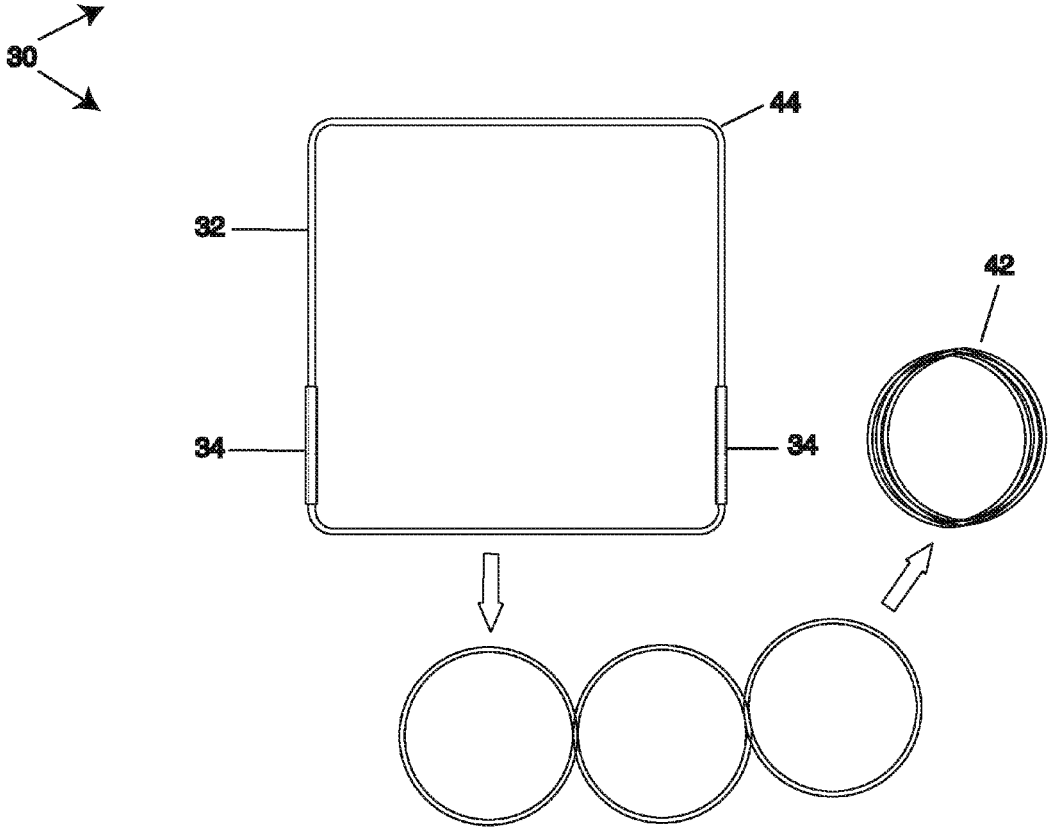
FIG. 5 is a rear view illustrating how at least one removable closed-loop resilient coilable frame with at least one connection member forms overlapping loops and coils for storage.

FIG. 5 illustrates how the removable coilable frame 32 can be formed into overlapping coils 42 when folded for storage.

Figure 6:
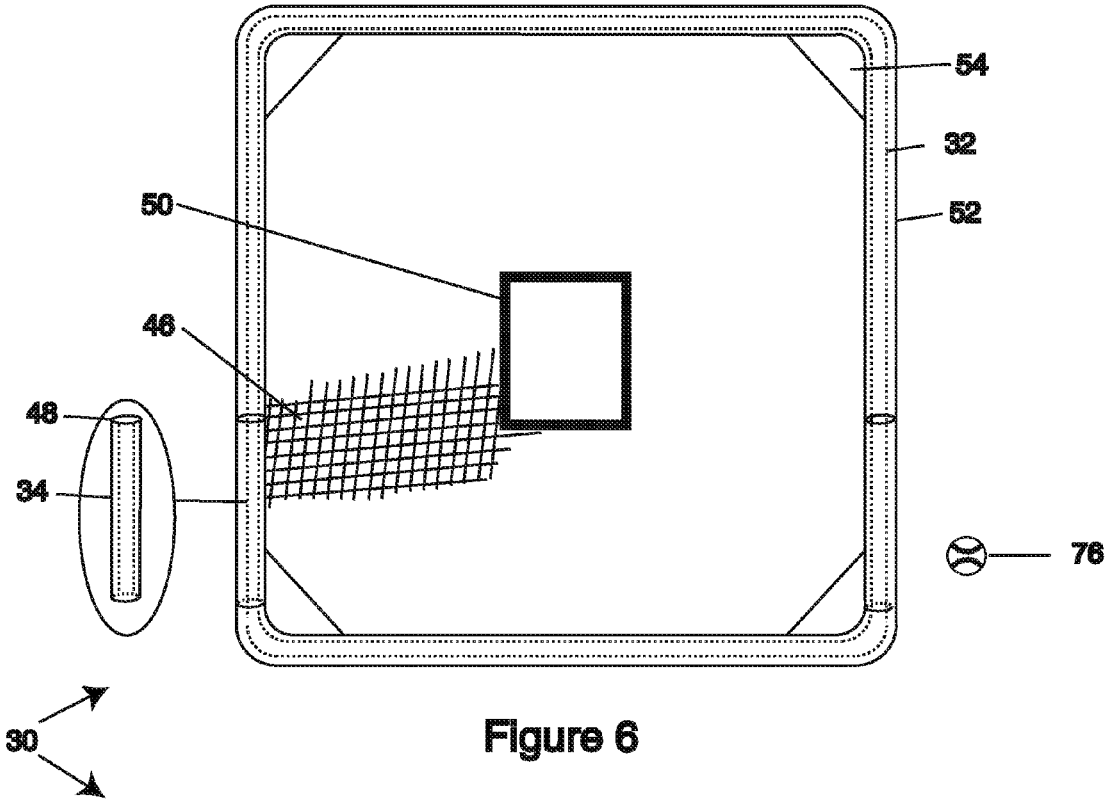
FIG. 6 is a rear view illustrating at least on removable closed-loop resilient coilable frame.
Figure 7:
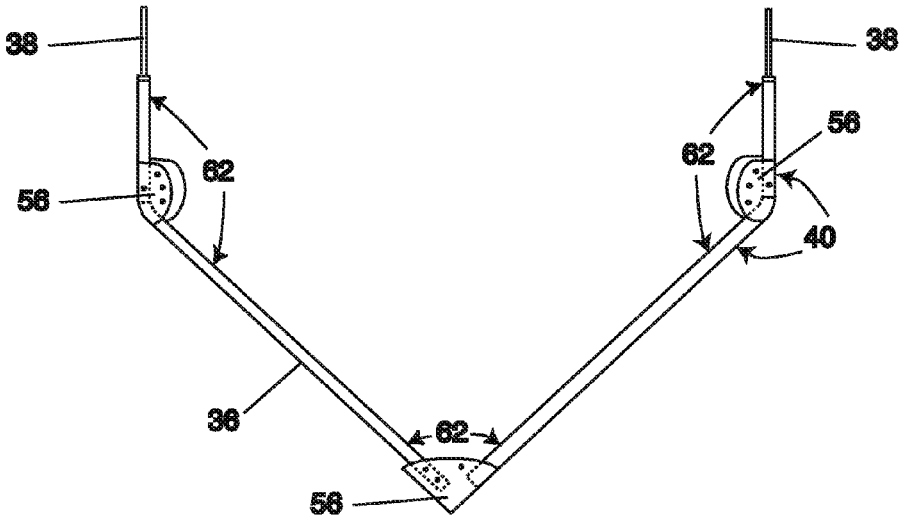
FIG. 7 is a perspective rear view illustrating a foldable support base.

FIGS. 6-7 show a barrier support structure 30 further comprising a barrier portion 46 attached to at least an area of the perimeter of the removable coilable frame 32 for impeding the flight of projectiles 76 such as baseballs, softballs, golf balls, hockey pucks, or the like.

The barrier portion 46 can be made out of netting, fabric, canvas, or any material suitable for working with projectiles 76. You can attach the barrier portion 46 by using springs, rings, clips, thread, material, hardware, or any suitable material for securing the barrier portion 46 to at least an area of the perimeter of the removable coilable frame 32.

Again referring to the connection member 34, the connection member 34 can include a pocket 48 attached to at least an area of the barrier portion 46 for accepting the attachment member 38 of the support base 36.

One way to create the pocket 48 is to take a piece of material approximately 36" in length and 6" in width. Fold the 6" width in half. This will now make the pocket 36" in length× 3" in width.

Now, insert at least an area of the barrier portion 46 into the 36" side length of the pocket 48 and sew around the top and the side of the pocket 48. Do not sew the bottom of the pocket 48. This will leave the bottom open for allowing the connection member 34 to be inserted into the pocket 48.

The pocket 48 can be made out of several different materials such as steel tubing, plastic, or any other material suitable for attaching to the connection member 34. Various sizes and shapes can also be predetermined based upon the fabricators preferences.

A target 50 can be attached to at least an area of the barrier portion 46 for defining a predetermined area. The target 50 can be made out of canvas, netting, rubber or any suitable material. The target 50 can be sewn into a rectangular shape, an oval, a square or any other shape desired. The target 50 can also be removably or adjustably attached so you can move the target 50 to any position desired, or remove the target 50 all together.

In addition, the target 50 can be fully enclosed or hollow at its center so projectiles 76 can be stopped by the inside of the target or so projectiles 46 can fly through the target. Also, the target 50 can have a catching pocket attached so projectiles can be caught and shagged in the target 50 so the balls are collected in one spot.

The target 50 can also be removably attached to the barrier portion 46 so the target 50 can be replaced by other features such as an attachment harness for an external device such as a pitching machine. To removably attach the barrier portion 46, a zipper, Velcro fastener, or the like can be used.

In yet another embodiment, the removable coilable frame 32 can be surrounded by a substantially tubular fabric sleeve 52, the tubular fabric sleeve 52 may surround at least a portion of the perimeter of the removable coilable frame 32 so as to allow the removable coilable frame 32 to axially rotate within the sleeve 52.

One way to surround a portion of the perimeter of the removable coilable frame 32 with a substantially tubular fabric sleeve 52, is to take a piece of fabricate and fold the fabric in half. Once folded, you can slide the removable closed-loop coilable frame 32 between the two halves of the fabric and secure the two fabric halves together. The fabric can be cloth, nylon, canvas, net, or any suitable material for surrounding a portion of the perimeter of the removable coilable frame 32. To secure the two fabric halves together you can sew, glue, clamp, weld, rivet, or use any other suitable securing method.

One way to support the shape of the corners of the removable coilable frame 32 is to attach at least one corner support 54 to at least one corner of the removable coilable frame 32. You can attach at least one corner support 54 to at least one corner by sewing, gluing, riveting or by using any acceptable means available.

In one embodiment, the corner support 54 is sewn to the fabric sleeve 52 at each corner of the removable coilable frame 32. The corner support 54 can help maintain the shape of the removable coilable frame 32 and can also be used in other areas of the frame 32 to help keep projectiles from bouncing or rolling out of the removable coilable frame 32.

For instance, if a projectile 76 is thrown into the removable coilable frame 32 and rolls out the side or the bottom of the removable coilable frame 32, then a corner support 54 can be strategically placed so the projectile 76 will hit the corner support 54. In this instance, the corner support 54 will act as a bumper and stop projectiles 76 from rolling out of the frame 32.

In yet another embodiment, the barrier support structure 30 further comprises a barrier portion 46 attached to the sleeve 52 so as to span at least a portion of the interior of the perimeter of the removable coilable frame 32 for impeding the flight of projectiles 76.

The barrier portion 46 can be made of netting, fabric, canvas, or any other suitable material for working with projectiles 76. The barrier portion 46 can be attached to the sleeve 52 by sewing, riveting, Velcro fastening, welding or by any suitable attachment methods.

In still another embodiment, the connection member 34 comprises a pocket 48 attached to at least a portion of the tubular fabric sleeve 52 for communicating with the attachment member 38 of the support base 36.

One way to create the pocket 48 is to take a piece of material approximately 36" in length and 6" in width. Fold the 6" width in half. This will now make the pocket 36" in length by 3" in width.

Now, lay at least a portion of the tubular fabric sleeve 52 underneath the pocket 48 and sew around the top and sides of both the pocket 48 and the fabric sleeve 52. Do not sew the bottom of the pocket 48. This will leave the bottom open for allowing the connection member 34 to be inserted into the pocket 48. Once complete, the pocket 48 will be connected to the fabric sleeve 52.

The pocket 48 can be made out of several different materials such as steel tubing, plastic, or any other material suitable for attaching to the connection member 34. Various sizes and shapes can also be predetermined based upon the fabricators preferences.

In yet another embodiment, the support base 36 is adjustable for adjusting the angle 40 between the removable coilable frame 32 and the support base 36.

To make the support base 36 adjustable, you need to create a pivoting mechanism 56 between the support base 36 and the attachment member 38. The pivoting mechanism 56 can be adjustable for adjusting the angle 40 between the removable coilable frame 32 and the support base 36. The pivoting mechanism 56 can be locked into place at different angles 40 and then unlocked to fold down for storage.

To make a pivoting mechanism 56, you can use a hinge, a ball joint, other pivoting mechanisms, or two side by side plates with pivoting and securing holes for mounting and securing the attachment member 38 to the support base 36.

In still another embodiment, the attachment member 38 is removable from the support base 36. The removable portion of the attachment member 38 can be made removable by creating a male to female type of connection, or by using Velcro fasteners, magnets, or any other type of known connection method.

A portion of the attachment member 38 of the support base 36 can be flexible. To make the attachment member 38 removable and flexible, you can create a plastic fitting and attach a fiberglass rod. The plastic fitting is formed so the male end of the plastic fitting can slide into the tubular female end of the attachment member 38.

This configuration allows the attachment member to be removable for storage and also to be flexible when a projectile 76 such as a baseball, softball, football, hockey puck, soccer ball or any other type of projectile hits the projectile barrier 46. This flexibility of the attachment member 38 helps absorb the impact of the projectile 76 and allows the projectile 76 to be restrained in a small area.

In one embodiment, you can make at least a portion of the support base 36 foldable 62 for ease of portability & storage. To make the support base 36 foldable 62, you need to create a pivoting mechanism 56 between the V-position of the support base 36. The pivoting mechanism 56 will allow the support base 36 to unfold and lock into place when in use and then unlock and fold 62 when not in use.

To make a pivoting mechanism 56 you can use a hinge, a ball joint, other pivoting mechanisms, or two side by side plates with pivoting and securing holes for mounting and securing the pivoting mechanism 56 to the V-position of the support base 36.

Figure 8:
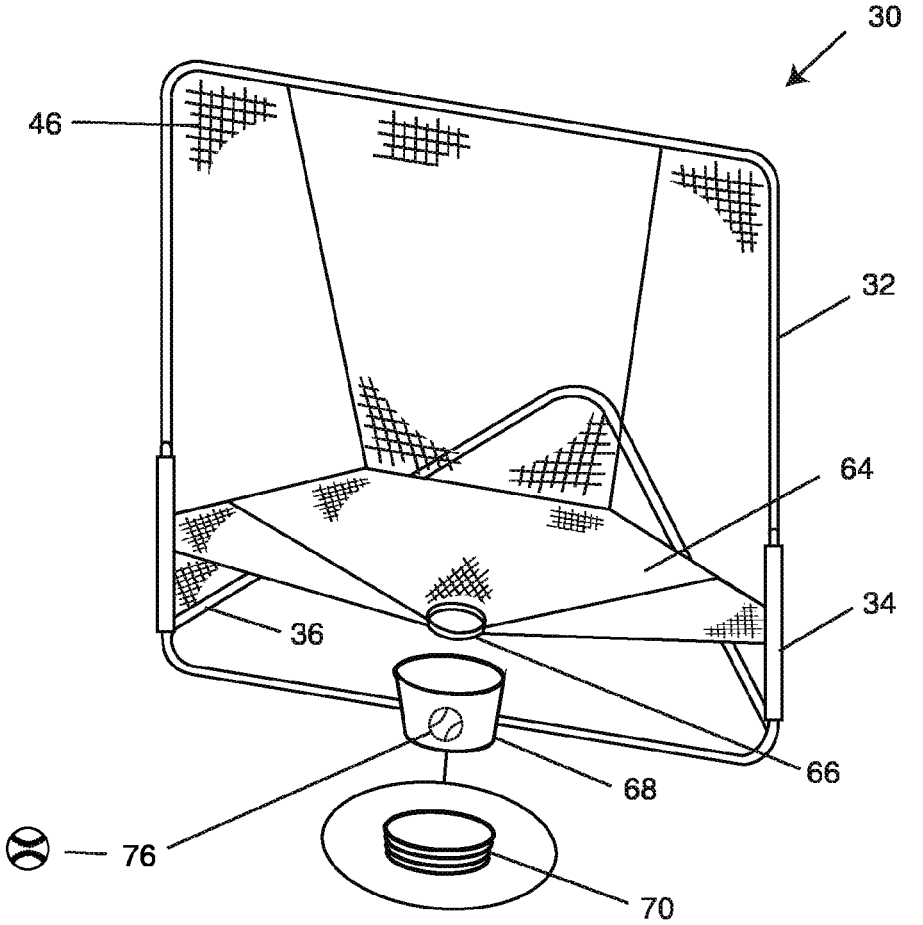
FIG. 8 is a perspective front view of a barrier support structure illustrating a catch for directing projectiles to a projectile collector. One projectile collector is disposed on a stand to lift the projectile collector off a surface.
Figure 8:
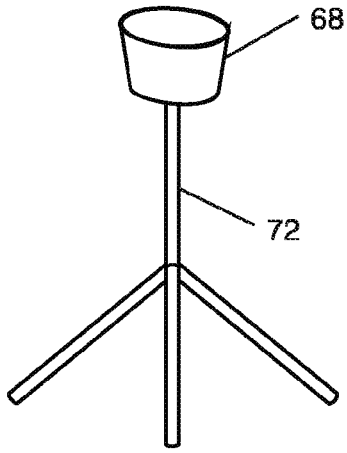

In FIG. 8, another embodiment of the barrier support structure 30 can include a barrier portion 46 with a catch 64 for directing projectiles 76 to a predetermined area. The catch 64 can direct projectiles 76 out the side of the barrier support structure 30, out the back of the support structure 30, or in this embodiment, out the front of the of the barrier support structure 30.

Still further, the catch 64 has an opening 66 for disposing projectiles 76 through the opening 66. One way to fabricate the catch 64 and the opening 66 is to sew a slope in the barrier portion 46. The slope can be angled down to the center to allow projectiles 76 to move to the center of the catch. To create the opening 66 you can cut a hole where the two slopes meet in the center. The opening 66 can be finished by tucking a portion of the cut out under the opening 66 and sewing a seam around the end to keep the barrier portion 46 from tearing or looking unfinished.

The barrier support structure 30 can further include at least one projectile collector 68 for collecting projectiles 76. The projectile collector 68 can be a bucket or any other type of mechanism that can retain projectiles 76. You can also make the projectile collector 68 compact 70 for storage.

One way to make the projectile collector 68 is to take spring steel and form the spring steel into round open coils that extend up from a surface. You can then sew fabric around the open coils. The coils act as the support structure for the projectile collector 68 while fabric contains the projectiles 76 in a bucket.

In its natural state, the spring steel coils can extend up from a surface to form a bucket type structure; however, you can compress the bucket for ease of storage by pressing your hand down on the spring steel coils. This compresses the bucket in a flat state for ease of shipping and storage. A securing device can be used to retain the spring steel and attached fabric in a compressed state. When you want to use the projectile collector 68 again, you can release the hooking device allowing the projectile collector 68 to spring back up into its extended position.

You can make the projectile collector 68 in many different embodiments. You can use fabric and spring steel as described above, you can use a molded plastic bucket, you can use a trough, or you can use anything suitable for containing projectiles 76.

In yet another embodiment, the barrier support structure 30 further comprises at least one stand 72 for disposing the projectile collector 68 above a surface.

There are many ways you can make a stand 72 for the projectile collector 68. One way is to create a tri-pod stand 72. The tri-pod stand 72 can have a center pole approximately 36" long. At the base of the center pole you can attach three legs that bend down at a 15 degree angle. You can fixedly or removably attach the legs to the center pole by welding, bolting, or using any acceptable attachment means. If you want to removably attach the legs to the center pole, you can weld at least three small stubs at the base of the center pole and then have the three legs slide into the stubs instead of having the legs weld directly to the center pole. You can use a securing method such as a clip, hardware, or the like to removably attach the legs to the stubs.

At the top of the center pole, you can mount the projectile collector 68 directly to the tri-pod stand 72 or attach a mounting mechanism to allow the projectile collector 68 to removably mount to the tri-pod stand 72. In this embodiment, you can rest the projectile collector 68 on the tri-pod stand, use all the projectiles 76 in the projectile collector 68, then remove the projectile collector 68 from the stand 72 and pick up the projectiles 76. Once the projectile collector 68 is refilled with projectiles 76, you can re-mount the projectile collector 68 on the stand 72. In this way a user can pick-up a projectile 76 without having to bend over.

Figure 9:
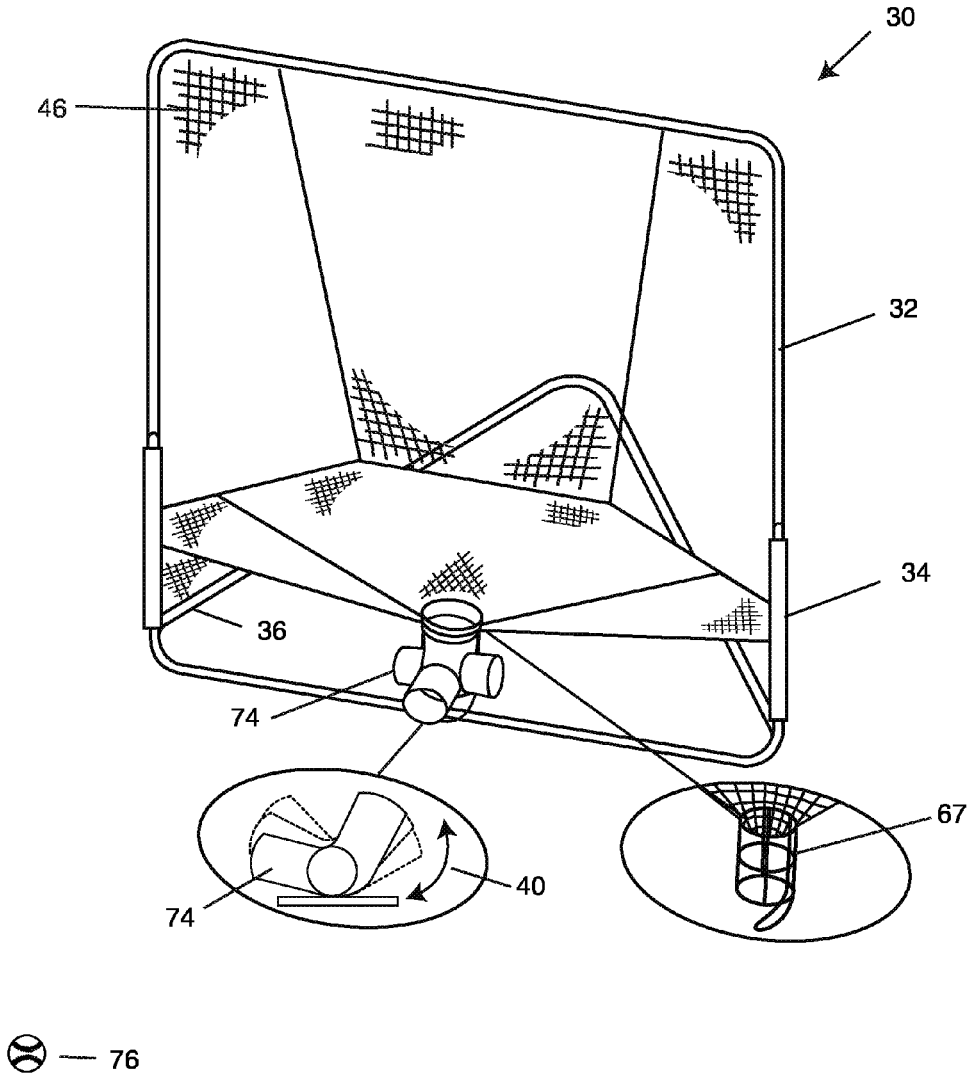
FIG. 9 is a perspective front view of a barrier support structure illustrating a ball return projectile collector for returning projectiles at variable heights.

FIG. 9 illustrates another embodiment of the barrier support structure 30. In this embodiment the projectile collector 68 is a ball return 74 for returning projectiles 76. In one embodiment, the ball return 74 is a pitching machine that mounts underneath the opening 66 of the catch 64. The ball return 74 can be adjustable for returning projectiles 76 at variable heights and angles.

In yet another embodiment, a trough 67 can be attached to the opening 66 for guiding projectiles 76 into the ball return 74. The trough 67 can be attached to the opening 66 with Velcro fastener straps, sewing, clips, or any acceptable attachment method.

Figure 10:
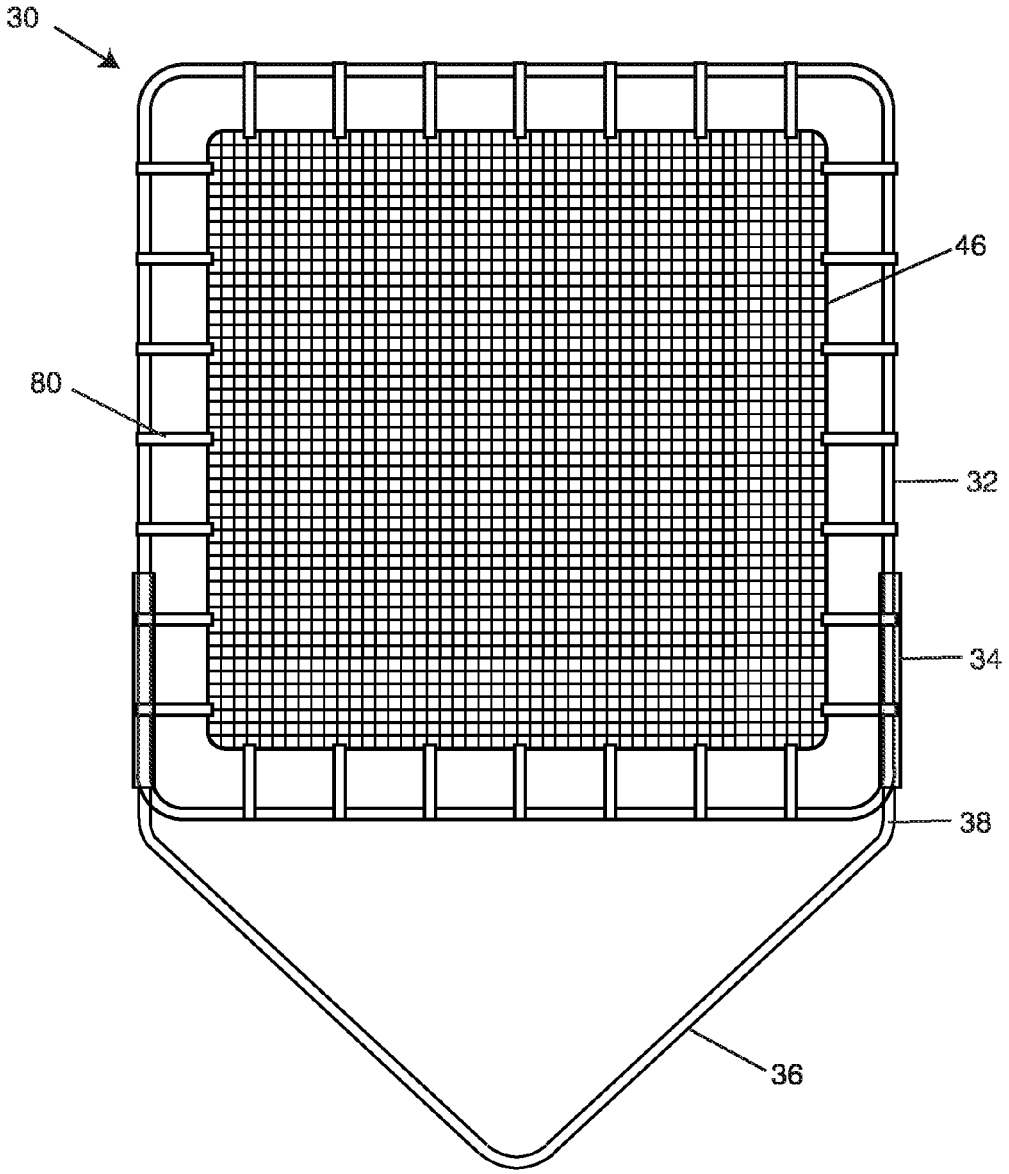
FIG. 10 is a perspective rear view of a barrier support structure illustrating a rebounding ball return.

FIG. 10 illustrates a barrier support structure 30 comprising a barrier portion 46 smaller in area than a spatial plane defined by the removable coilable frame 32 and at least one resilient strap 80 connecting the barrier portion 46 to the removable coilable frame 32.

The barrier portion 46 can be made out of net, canvas, or any other material suitable for working with projectiles 76. At least one resilient strap 80 can be made out of elastics, rubber bands, springs, or any suitable resilient material and can connect the barrier portion 46 to the removable coilable frame 32.

In one embodiment, several resilient straps 80 can be attached between the barrier portion 46 and the removable coilable frame 32. In this case, resilient straps 80 can be attached around the entire perimeter of the removable coilable frame 32 and around the outer perimeter of the barrier portion 46.

Figure 11:
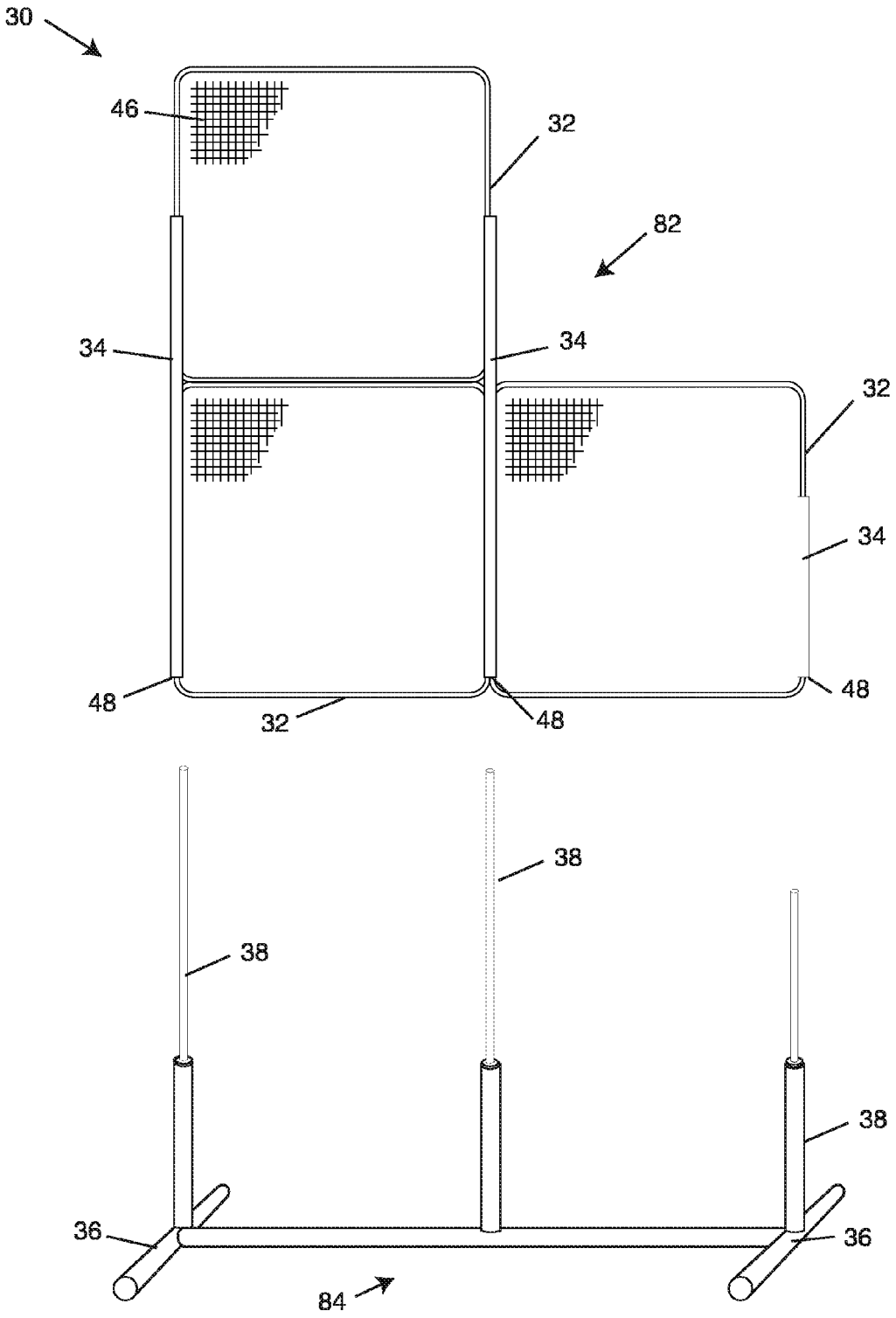
FIG. 11 is a perspective front view of a barrier support structure illustrating at least one removable closed-loop coilable frame in an L-shaped embodiment and a support base in an H-shaped embodiment.

FIG. 11 refers to a barrier support structure 30 where the removable coilable frame 32 is substantially L-shaped 82. There are several ways to make the frame L-shaped 82.

In one embodiment, you can fabricate three square removable closed-loop coilable frames 32. Each frame's 32 perimeter can be square and measure approximately 3'6" by 3' 6". Now, you can take the right hand side of the first closed-loop removable coilable frame 32 and place it next to the left hand side of the second removable closed-loop coilable frame 32. Next, you can take the bottom of the third closed-loop removable coilable frame 32 and place it on top of the first closed-loop removable coilable frame 32. Further, you can attach at least three connection members 34. One on the left hand side, one in the middle, and one on the right hand side of the substantially L-shaped 82 removable coilable frame 32. The connection members 34 can further include a pocket 48 for allowing the attachment members 38 of the H-shaped 84 support base 36 to slide into the pockets 48 so you can secure the L-shaped 82 removable coilable frame 32 to the attachment member 38 of the H-shaped 84 support base 36.

Now, take the top of the first removable coilable frame 32 and attach the bottom of the third removable coilable frame 32. Next, attach one connection member 34 to the left hand side of both the first and third removable coilable frame 32. The connection member 34 can comprises a pocket 48.

Figure 12:
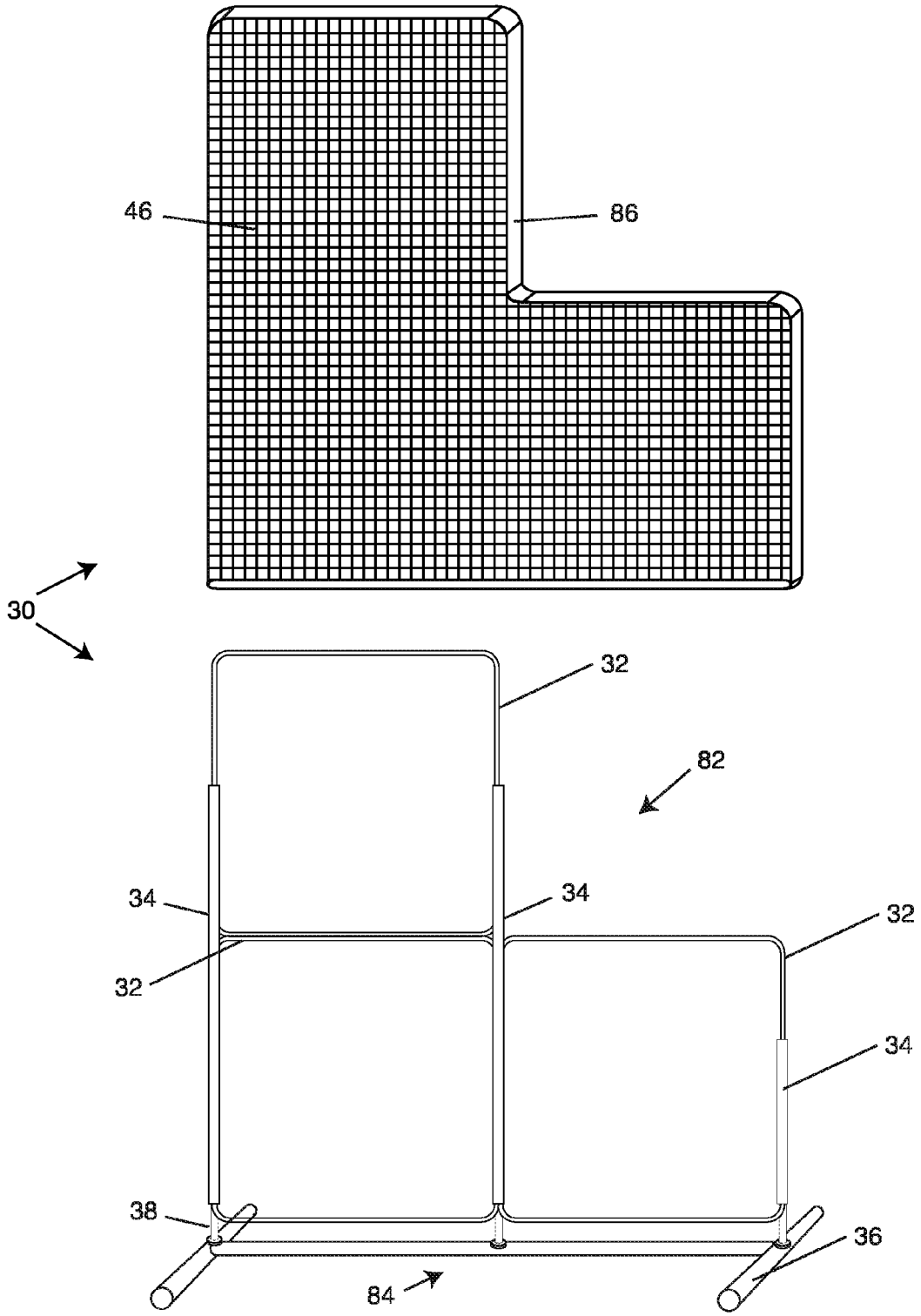
FIG. 12 is a perspective front view of a barrier support structure illustrating a barrier portion cavity for draping over at least one removable closed-loop resilient coilable frame member.

FIG. 12 refers to a barrier support 30 structure that has a barrier portion 46 for draping over the removable coilable frame 32. The barrier support structure 30 can further include a barrier portion cavity 86 for draping over the at least one removable coilable frame 32.

One way you can fabricate a barrier portion cavity 86 is to cut out two substantially identical barrier portions 46 in a substantial L-shape 82. The L-shape 82 barrier portions 46 should be a little larger than the size of the L-shaped 82 removable coilable frame 32. This will allow the barrier portion cavity 86 to slide over the L-shaped 82 removable closed-loop resilient coilable frame 32.

Once the two barrier portions 46 are cut to the pre-defined size, you can attach the two barrier portions 46 together by sewing, gluing, or by any other suitable means to attach both sides and the top together.

In one embodiment, you can leave the two bottoms of the barrier portions 46 unattached to create the barrier portion cavity 86. This allows you to slide the L-shaped 82 barrier portion cavity 86 over the L-shaped 82 removable closed-loop resilient coilable frame 32.

DETAILED OPERATION OF THE PREFERRED EMBODIMENTS

FIGS. 1-7 illustrate an embodiment of a barrier support structure 30 that can be used to stop projectiles 76. To use this embodiment you can send projectiles 76, such as baseballs, softballs, golf balls, footballs, hockey pucks, tennis balls, or the like, at the barrier portion 46. Once a projectile 76 hits the barrier portion 46, the projectile 76 falls to the surface.

In some cases, baseball and softball players, tennis players, golfers, hockey players, soccer players, or many other types of players can hit or kick a ball into the barrier support structure 30. In other cases, baseball and softball players, football players, and other players that need to practice throwing can throw a projectile 76 into the barrier support structure 30. In both cases, once the projectile 76 hits the barrier support structure 30, the projectile 76 falls to a surface and comes to rest. In this circumstance, the user must go and pick-up the projectiles 76 and then repeat the operation again.

Once the user is finished practicing, the user can coil at least one removable closed-loop resilient coilable frame 32 into overlapping coils 42 and place the frame 32 into a storage bag for portability and storage.

The support base 36 can be folded or disassembled and placed in the same storage bag if desired.

The best part about this design is that you can replace this embodiment of the removable closed-loop resilient coilable frame 32 with another embodiment that functions totally different. This is because the removable closed-loop resilient coilable frame 32 is not permanently attached to the support base, but comes unattached when required.

This allows the user to replace the first embodiment with a second embodiment of the closed-loop resilient coilable frame 32.

FIG. 8 shows a second embodiment of the removable closed-loop resilient coilable frame 32 that can be used to catch projectiles. In this embodiment, the barrier portion 46 has a catch 64 with an opening 66 at the bottom. Once the projectile 76 is stopped by the barrier support structure 30, the projectile 76 is guided by the catch 64 out the opening 66 in the barrier portion 46. So the user doesn't have to pick up projectiles 76 from all over the surface, a projectile collector 68 can be place under the opening 66 to collect the projectiles.

In yet another embodiment, the user can have an additional projectile collector 68 fixedly or removably attached to at least one stand 72. In this instance, a user can fill the additional projectile collector 68 full of projectiles 76. Then send each projectile 76 into the barrier support structure 46. Once the barrier support structure 46 stops the projectile 76, the projectile 76 falls into the projectile collector 68 located underneath the opening 66 in the catch 64.

After the projectile collector 68, located on the stand 72 is empty, the user can remove that projectile collector 68 from the stand 72 and place it underneath the opening 66 in the catch 64 of the barrier support structure 30. The second projectile collector 68, now filled with projectiles 76, can be taken back and mounted on the stand 72. In this embodiment, the user never has to chase a projectile 76. The projectile collectors 68 can be compressed for storage, while the stand 72 can be disassembled and folded up along with the support base 36. The removable closed-loop resilient coilable frame can be coiled up and quickly stored as well.

FIG. 9 shows a similar barrier support structure 30 as illustrated in FIG. 8. This embodiment not only can catch projectiles 76, but can also pitches projectiles 76 back to you. To convert to this embodiment, all you have to do is replace the projectile collector 68 bucket with a projectile collector 68 ball return 74.

In this embodiment the new projectile collector 68 is a ball return 74 and in some cases, the ball return 74 can be a pitching machine placed underneath the opening 66 of the catch 64 in the barrier support structure 30. In yet another embodiment, a trough 67 can be attached to the opening 66 in the catch 64 to help guide projectiles 76 into the ball return 74.

In these embodiments, a player can send projectiles 76 to the barrier support structure 30, the barrier support structure 30 can stop the projectile 76, drop the projectile 76 through the opening 66 in the catch 64, and into the ball return 74. The ball return 74 can then send the projectile 76 back to the user.

The user can also adjust the angle of the ball return 74 by pivoting the angle of the ball return 74. The speed at which the projectile 76 returns can be adjusted by using a variable speed control.

In some cases, a baseball or softball player can adjust the angle and speed of the returned projectile 76 for returning grounders, line drives, & fly balls. This allows a player to work on all the defensive skills needed to be a great player.

In another case, a user can throw a projectile 76 into the barrier support structure 30 and then hit the projectile 76 when the projectile is returned. Hockey players could use a similar embodiment for hitting hockey pucks back into the barrier support structure 30 when the puck is returned. This is a great way to work on your offensive hitting skills.

FIG. 10 illustrates a mechanical projectile return that can use at least one resilient strap 80 to spring projectiles 76 back to you. To convert to this embodiment, you can remove the previous removable closed-loop resilient coilable frame 32 from the support base 36 and place this new coilable frame 32 embodiment into the support base 36. This new embodiment is illustrated in FIG. 10.

One way to use this embodiment is to send projectiles 76 to the barrier portion 46. Once a projectile 76 hits the barrier portion, the resilient straps flex back and then spring forward sending the projectile 76 back to the user. You can throw a baseball, softball, soccer ball, hockey puck, or any other type of projectile 76 at the barrier portion 46 and have the projectile 76 returned back to you. You can also adjust the angle of the removable coilable frame 32 by adjusting the pivoting mechanism 56 of the base support 36, see FIG. 7, so you can have projectiles 76 returned back to you at different angles.

FIGS. 11-12 show another embodiment of a barrier support structure 30 that can act as a protective screen. In this embodiment, you have three removable closed-loop resilient coilable frames 32 put together to form a substantially L-shaped removable coilable frame 32. These three removable coilable frames 32 have three connection members 34 running vertically up the frame 32. Each connection member 34 has a pocket 48 for allowing three attachment members 38 to slide inside the pockets 48. One attachment member 38 per pocket 48.

The attachment members 38 can include removable and flexible fiberglass rods. These fiberglass rods can help support the L-shaped removable coilable frame 32 in its assembled position. For storage, simply remove the attachments members 38 from the connection members 34. This will allow the three smaller removable coilable frames 32 to collapse one on top of each other. Then the collapsed frames 32 can be formed into overlapping coils 42 for storage.

The substantially H-shaped 84 support base 36 acts to support the L-shaped 82 removable coilable frame 32 at a predetermined angle. Once the barrier support structure 30 is assembled, a barrier portion 46 with a barrier portion cavity 86 can drape over the barrier support structure 30. This provides a protective screen for people to stand behind so they can be protected from a projectile 76 that is coming toward them.

You can use this embodiment in a batting cage, a baseball or softball field, or any other place that you need protection from a projectile 76 coming toward you at high speeds. In this embodiment, the barrier support structure 30 acts as a protective screen.

SCOPE OF INVENTION

The present invention may be embodied in other specific forms without departing from its spirit or essential characteristics. The described embodiments are to be considered in all respects only as illustrative and not restrictive. Thus, the scope of the invention should be determined by the appended claims and their legal equivalents, rather than by the foregoing description. All changes which come within the meaning and range of equivalency of the claims are to be embraced within their scope.

I claim:

1. A sports barrier support structure for resting on a support surface for impeding the flight of projectiles comprising:

a support base for placement on the support surface, the support base comprising:

a first upright attachment member having a flexible upper portion, a lower portion and a fitting removeably connecting the upper flexible portion to the lower portion;

a second upright attachment member having a flexible upper portion and a lower portion; a fitting removeably connecting the upper flexible portion to the lower portion;

wherein the first and second flexible upper portions help absorb the impact of the projectiles and allow the projectiles to be restrained in a small area;

a resilient coilable frame having a top, a bottom, a first side, and a second side, wherein the top, the bottom, the first side, and the second side form a perimeter when uncoiled;

a barrier portion attached to the perimeter of the resilient coilable frame for impeding the flight of projectiles; and first and second attachment sleeves formed on the first and second sides of the resilient coilable frame, wherein the first and second upright attachment members are slidably received within the first and second attachment sleeves; and wherein the first and second attachment sleeves maintain a predetermined angle between the removable coilable frame and the foldable support base.

2. The barrier support structure in claim 1, wherein a substantially tubular sleeve surrounds at least a portion of the perimeter of the resilient coilable frame allowing the resilient coilable frame to axially rotate within the tubular sleeve.

3. The barrier support structure in claim 1, wherein the resilient coilable frame is substantially square in shape.

4. The barrier support structure in claim 1, further comprising at least one corner support for constraining at least one corner of the resilient coilable frame.

5. The barrier support structure in claim 1, further comprising:

a) a first pivoting mechanism connecting the support base and the first upright attachment member, the first pivoting mechanism adjusts the first side of the coilable frame's upright angle with respect to the support surface; and b) a second pivoting mechanism connecting the support base and the second upright attachment member, the second pivoting mechanism adjusts the second side of the coilable frame's upright angle with respect to the support surface.

6. The barrier support structure in claim 1, further comprising a pivoting mechanism attached to the support base for allowing the support base to fold.

* * * * *